United States Patent [19]

Fenwick

[11] 4,411,035

[45] Oct. 25, 1983

[54] MATERNITY CARE BED

[76] Inventor: Loel Fenwick, S. 161 Adams, Spokane, Wash. 99201

[21] Appl. No.: 248,701

[22] Filed: Mar. 30, 1981

[51] Int. Cl.[3] ..... A61G 7/00

[52] U.S. Cl. ..... 5/68; 5/66; 269/325

[58] Field of Search ..... 5/60–69, 5/90; 269/325, 327

[56] References Cited

U.S. PATENT DOCUMENTS

| | | | |
|---|---|---|---|
| 3,281,141 | 10/1966 | Smiley et al. | 5/66 |
| 4,057,240 | 7/1977 | Damico et al. | 269/325 |
| 4,139,917 | 2/1979 | Fenwick | 5/60 |

FOREIGN PATENT DOCUMENTS

| | | | |
|---|---|---|---|
| 1456058 | 10/1966 | France | 5/60 |
| 497662 | 4/1938 | United Kingdom | 5/60 |
| 1389344 | 7/1975 | United Kingdom . | |

OTHER PUBLICATIONS

The Borning Corporation Brochure (1978).

*Primary Examiner*—Alexander Grosz
*Attorney, Agent, or Firm*—Wells, St. John & Roberts

[57] ABSTRACT

A maternity care bed having an elevationally adjustable framework supported on a floor. A patient support surface of a central seat section is movably mounted on the framework about a pivot axis adjacent the head of the bed. A head section is pivoted to the seat section. A foot section is located adjacent the remaining end of the seat section. It is also pivotally mounted adjacent the head of the bed for elevational adjustment of both the seat and foot section independently of one another. The foot section includes a patient support surface that can be raised to a position in which it serves as an extension of the patient support surface of the seat section. It also can be lowered and retracted beneath the seat section while the seat section is in a raised position.

10 Claims, 11 Drawing Figures

MATERNITY CARE BED

TECHNICAL FIELD

This disclosure relates to a combined labor, delivery and patient care bed for maternity facilities. It is a multipurpose bed having independently movable sections adjustable to a variety of positions accommodating the usual requirements of a mother before, during and after childbirth.

Background Art

This disclosure relates to a special purpose hospital bed designed to serve the needs of both the hospital staff and patient during both labor and delivery, as well as during the usual hospital stay following the birth of a child. It provides an all-purpose bed for gynecological and obstetrical purposes, or for other pelvic operations on both male and female patients.

This bed eliminates the need for transferring a patient from one bed to another or from one room to another for various normal procedures. It particularly lends itself to the use of regional anesthesia during birth and adapts well to the needs presented by prepared childbirth programs. It takes into consideration the emotional, physical and aesthetic requirements of the patient, and serves to simplify and expedite childbirth. Its successful utilization in a maternity program should reduce the average hospital stay required by childbirth without compromising the physical needs of both the patient and attending medical personnel.

The bed further provides the patient with the type of support now available in a specialized obstetric chair or "birth chair", where the patient can comfortably assume a seated posture best calculated for successful natural childbirth. Finally, should the need arise, the patient can be placed in the lithotomy position to provide adequate exposure for forceps delivery or other reasons.

Single-room short stay maternity care can do more than any other concept to provide safe childbearing at reduced cost. This has been demonstrated in many centers throughout the country, and an increasing number are moving in this direction with many notable successes. The major impediment to more universal acceptance of this method has been the inability to achieve satisfactory safety for all patients undergoing different complexities of vaginal delivery. Most facilities therefore limit the use of childbearing rooms to only those mothers considered to be at low risk. While their safety record has been generally impressive, there remains the possibility of patient endangerment in the event of a sudden unexpected emergency. This risk, though small, has understandably been the major factor limiting general national adoption of the concept.

The multipurpose childbearing bed disclosed herein makes it possible for all women undergoing either straightforward or complicated vaginal delivery to have the same or greater safety than that previously only attainable in a system of specialized rooms. As the need for cesarean section now constitutes the only contraindication to delivery in a childbearing room equipped with a multipurpose bed, the single-room system can now be safely used by almost 90% of all mothers.

Conventional surgical-type delivery tables have a seat section or center section from which a foot section is movably mounted. The two normally are interconnected to move in unison in response to adjustment of the seat section. One cannot independently position the foot section and maintain its position if the seat section is subsequently adjusted.

A prior form of a multipurpose maternity care bed is illustrated in my prior U.S. Pat. No. 4,139,917, issued Feb. 20, 1979. The bed disclosed in this patent comprises a pair of independent, floor-supported modules which are releasably connectable to one another.

U.S. Pat. No. 4,057,240 discloses an examination table having an adjustable frame that supports a tiltable seat section and tiltable backrest. The seat section has a forward central indentation that overlies a retractable leg rest and drainage pan. However, the examination table is not constructed in the form of a bed compatible with normal furniture design and maternity care requirements. No provision is made for extension of the upper patient support surfaces beyond the forward edge of the illustrated seat structure.

U.S. Pat. No. 3,593,350 illustrates a hospital-type bed with an elevationally adjustable frame. The bed has several mattress sections movable relative to one another on the elevationally adjustable frame.

DISCLOSURE OF THE INVENTION

The present multipurpose bed has a seat section elevationally movable between a lowered position and a raised position. A foot section is movably mounted at one end of the seat section. Operational elements interconnect the two sections for independent adjustment of them relative to one another.

It is an object of this invention to provide a multipurpose bed with movable seat and foot sections which can be arranged in extended positions to support a prone person in either a horizontal or rearwardly inclined orientation.

Another object of this invention is to provide such a bed with a novel foot section capable of supporting a patient when extended and including an upwardly open receptacle for receiving drainage fluids when retracted beneath the front end of the seat section.

Another object of the invention is to independently mount the seat and foot sections on an elevationally adjustable framework.

Another object of the invention is to provide a multipurpose maternity care bed in the form of a single floor-supported module.

These and further objects are incorporated within the general details of the bed illustrated in the accompanying drawings and described more specifically below.

BEST MODE FOR CARRYING OUT THE INVENTION

Figure 1:
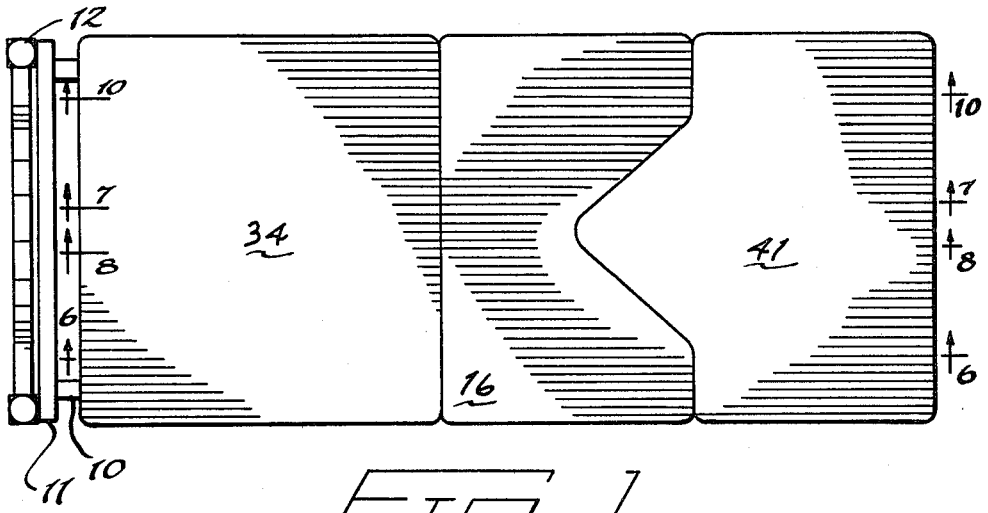
FIG. 1 is a plan view of the bed.

The bed shown in the drawings is a physical embodiment of a structural design to make safe, single-room maternity care a reality. The bed has the versatility to meet all normal requirements of a maternity patient from admissions to hospital discharge. It is particularly adapted to the needs of short-stay maternity centers, and permits the users to fully utilize the advantages of prepared childbirth programs with or without the use of local anesthesia.

The bed incorporates the features of a labor bed, an obstetric chair, a delivery bed, an operative-delivery table, a post-delivery bed, and an intensive care bed in a single, full-sized, comfortable bed that is aesthetically compatible with a patient's room. It permits the patient to remain in common, familiar and reassuring surroundings through and after childbirth. This eliminates a major source of patient endangerment and permits uninterrupted fetal monitoring.

The bed basically comprises a system of movable patient support surfaces which can be positioned relative to one another to achieve different positions of the patient without transferring the patient to a surgical table, a delivery table or other appliances not an integral part of the bed itself. It assists the patient in achieving a sitting or reclining position in which the patient's trunk, pelvis and legs are each supported by surfaces of diminishing elevation. These surfaces are an integral part of the upper surface of the bed and are the same surfaces which would normally support the patient in a supine or lateral position. Under normal conditions, the patient can be effectively supported in the bed for delivery without the use of leg supports, pillows or extraneous backrests. The bed also presents an interlocking indentation and projection along the patient support surfaces which are movable in relation to one another to present a centrally located space for access to the patient and/or delivery of a baby.

In describing the features of the bed, reference will be made to the respective ends of the bed as being the "head" and "foot" ends in relation to the head and feet of a patient using it. Longitudinal direction will refer to that direction along the bed between its head and foot. The various longitudinal relationships between the bed sections will be referred to as an "upper" end directed toward the head of the bed and a "lower" end directed toward the foot of the bed. Transverse directions shall be perpendicular or across the longitudinal direction.

Figure 2:
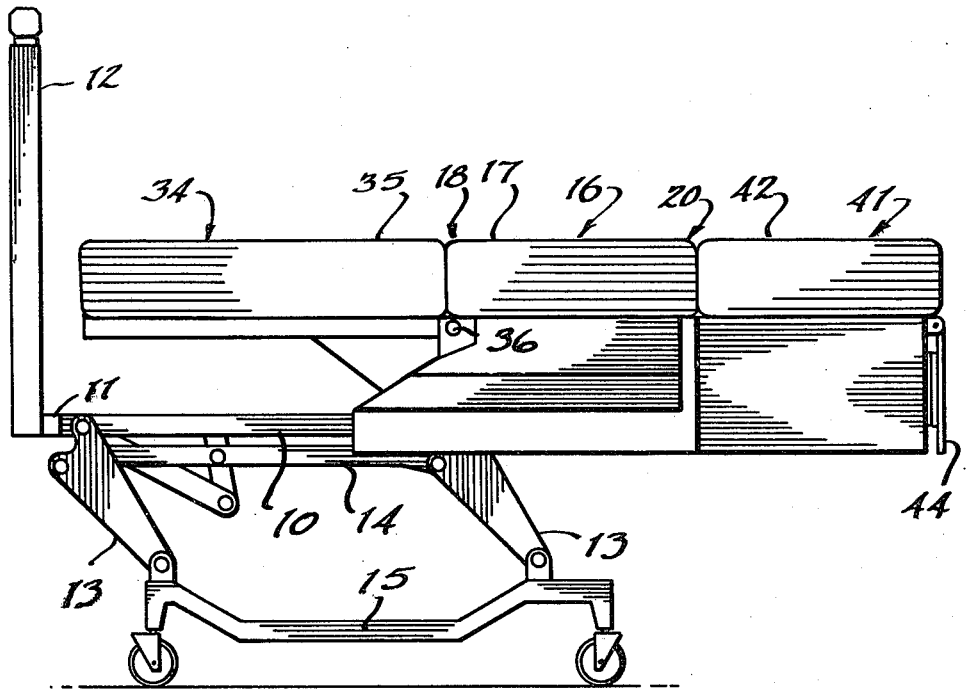
FIG. 2 is a side elevation view with the bed horizontal.
Figure 3:
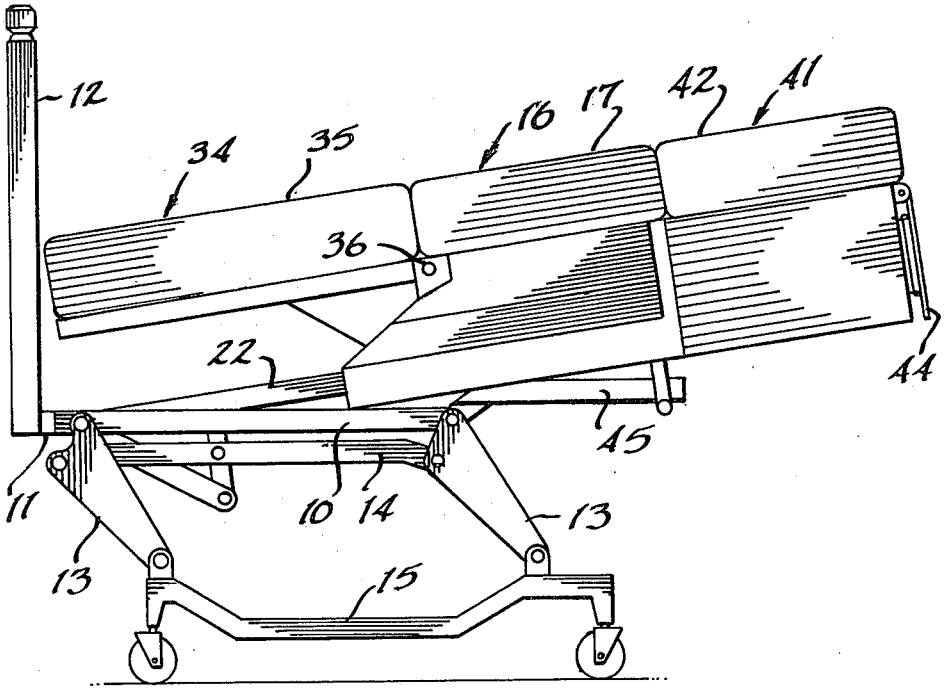
FIG. 3 is a side elevation view with the bed rearwardly inclined.

The functional elements of the illustrated bed essentially include a seat section 16, a foot section 41, and a head section 34. These three elements are movably adjustable relative to one another on an elevationally movable framework. They can be arranged at any desired elevation while in either a horizontal extended coplanar configuration, as shown in FIG. 2, or a rearwardly inclined coplanar configuration, as shown in FIG. 3 (Trendelenberg's position).

Figure 4:
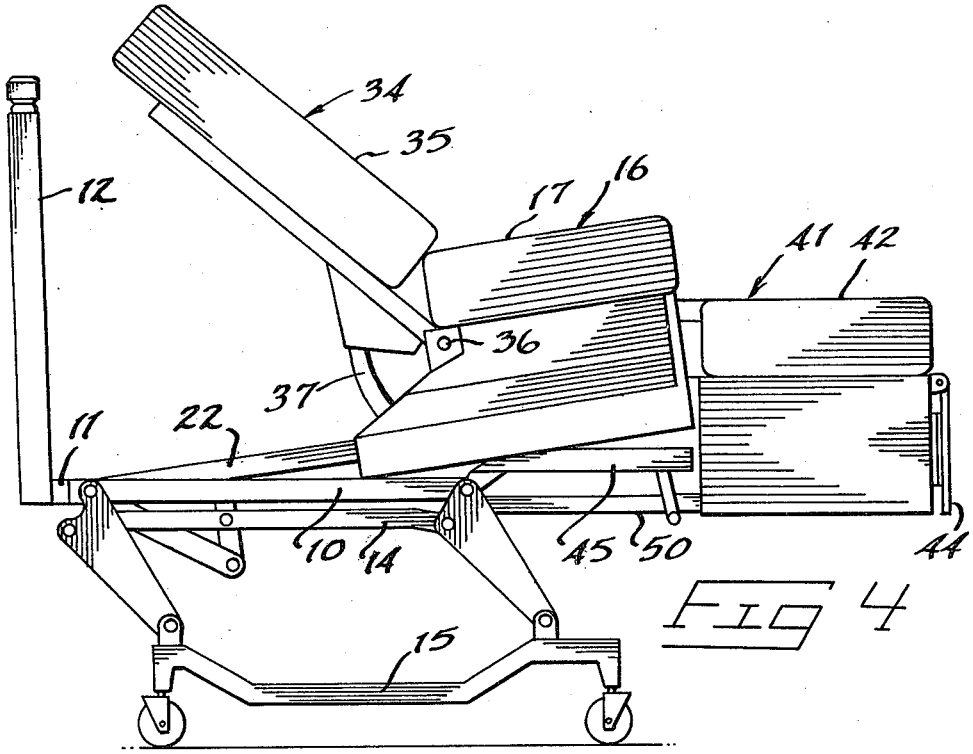
FIG. 4 is a side elevation view with the bed in a chair configuration.
Figure 5:
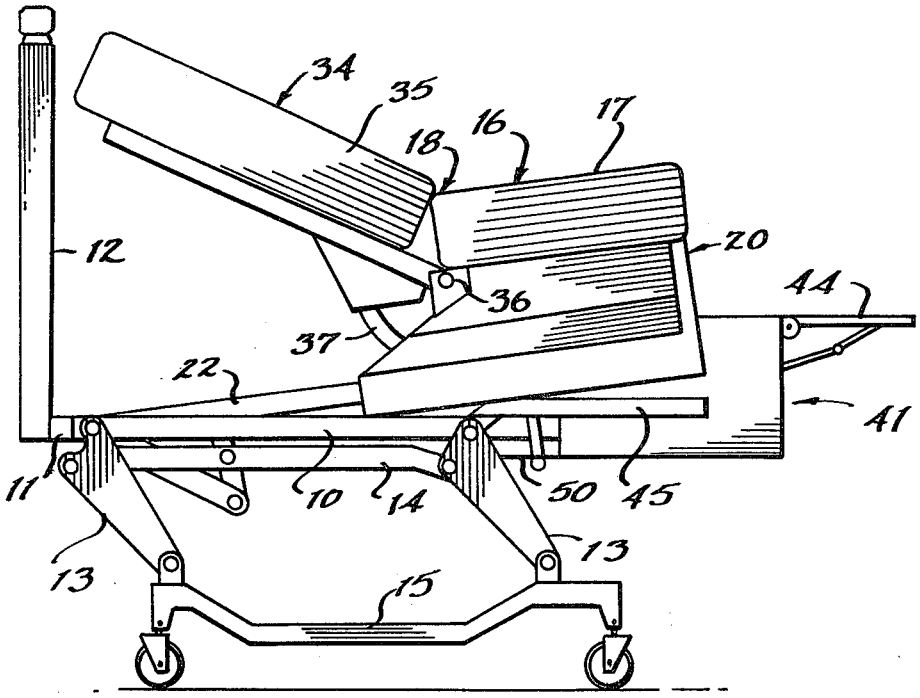
FIG. 5 is a side elevation view with the bed in an operating configuration.

The bed sections also can be arranged in a configuration similar to that of an obstetric chair or "birth chair", where the seat section 16 supports the person arranged upon it. This configuration is shown in FIG. 4. As shown in FIG. 5, when the bed is so arranged, the foot section 41 can be lowered and retracted beneath the raised position of seat section 16. The seat section 16 inclines rearwardly as it is raised from its lowered or horizontal position.

These several basic configurations of the bed sections and the many further available configurations possible between the extreme positions of the movable elements, accommodate the varying needs of both patient and attending personnel during all phases of patient care relating to childbirth and other medical operations.

The center seat section 16 includes an upper patient support surface 17. The illustrated upper patient support surface 17 is the top surface of a cushion or mattress, which can be either separable from seat section 16 or formed integrally on it. The upper patient support surface 17 extends between a transverse upper end 18 and a transverse lower end 20. The lower end 20 includes a central indentation 21 formed across it to facilitate access to the pelvic area of a patient.

The foot section 41 is located adjacent the lower end 20 of seat section 16. It is movably mounted for both elevational and longitudinal adjustment relative to the seat section 16. Foot section 41 also includes an upper patient support surface 42 on which the legs and feet of a patient can rest. Again, this surface 42 is illustrated as the upper surface of a removable cushion or mattress, but can be formed integrally as part of foot section 41 if desired. Foot section 41 includes an upwardly open receptacle 57. Surface 42 includes a projection 58 complementary to the transverse shape of the indentation 21 on the surface 17 of seat section 16.

A head section 34 is movably mounted about a transverse axis at the upper end of seat section 16 for angular adjustment relative to it. It supports the head and upper torso of a patient using the bed. It includes an upper patient support surface 35, again shown as the upper surface of a separable cushion or mattress.

All of the above-described movable sections are mounted to a common elevationally adjustable framework supportable on a floor. This framework basically includes a pair of longitudinal frame sides 10 connected by a transverse frame end 11. When desired, an upright headboard 12 can be fixed across the frame end 11.

The frame sides 10 are supported by four angular uprights 13. The uprights 13 at each side of the framework are pivotably interconnected by upper parallel braces 14. Their lower ends are pivotably connected to a support platform 15 which is mounted on suitable roller assemblies for facilitating movement about a floor surface.

Figure 6:
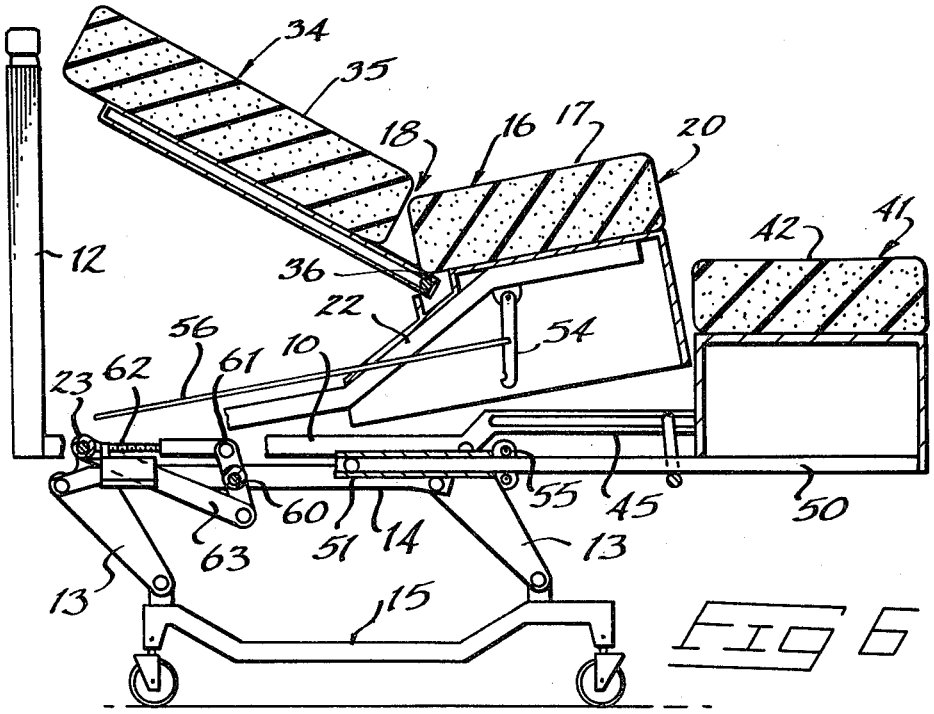
FIG. 6 is a sectional view taken along line 6—6 in FIG. 1, showing the bed configuration of FIG. 4.
Figure 9:
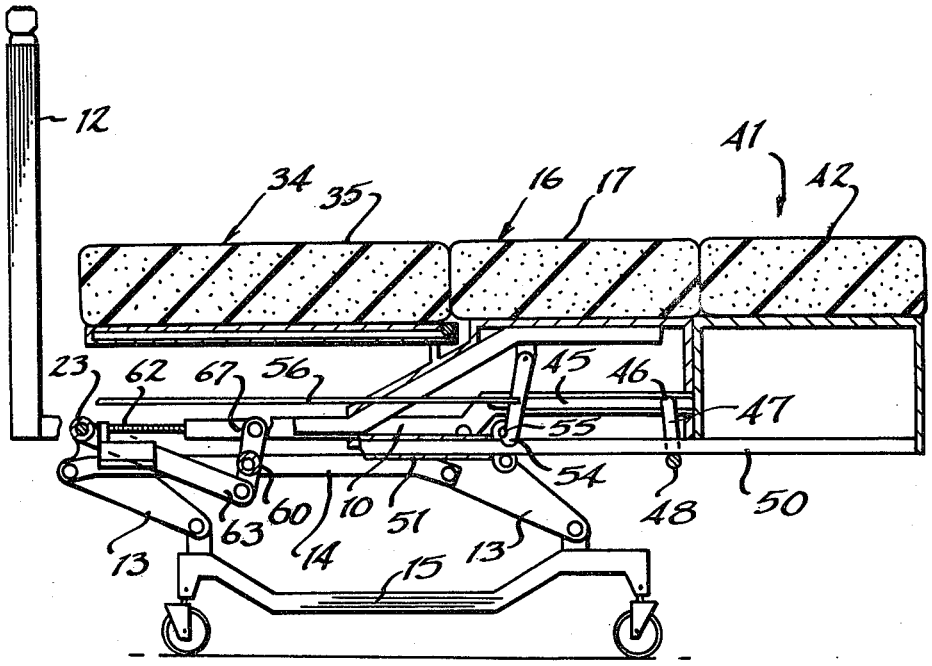
FIG. 9 is a sectional view taken along line 6—6 in FIG. 1, showing the lowered bed in a horizontal configuration.

The framework is elevationally adjustable by a mechanism best seen in FIGS. 6 and 9. A transverse shaft 60 pivotably mounted across the intermediate portions of the parallel braces 14 pivotally supports a rigid crank 61 about its transverse axis. One end of crank 61 is pivotally connected to the outer end of an extensible motorized shaft assembly 62. The remaining end of assembly 62 is pivotally anchored to cross member 23 described below. The shaft assembly 62 can be an interconnected threaded screw device driven by an electric motor or any equivalent apparatus, whether motor driven or manually operated. The remaining end of crank 61 is pivotally connected to a rigid link 63 that extends back to pivotal connections at the upper pivots on the uprights 13.

The extensible shaft assembly 62 is operational to cause relative longitudinal motion between the frame sides 10 and the parallel braces 14. This results in elevational adjustment of the framework due to the parallelogram relationship between the platform 15, uprights 13, braces 14 and sides 10. Raised and lowered positions of the framework are shown in FIGS. 6 and 9, respectively.

The seat section 16 is carried by a pair of longitudinal extensions 22 connected across their outer ends by a transverse cross member 23. The cross member 23 is pivotally supported on the bed about a transverse axis. The axis of cross member 23 is coaxial with the upper axes on the uprights 13. The extensions 22 pivotally connect seat section 16 to the framework at a location adjacent to its head end.

Figure 10:
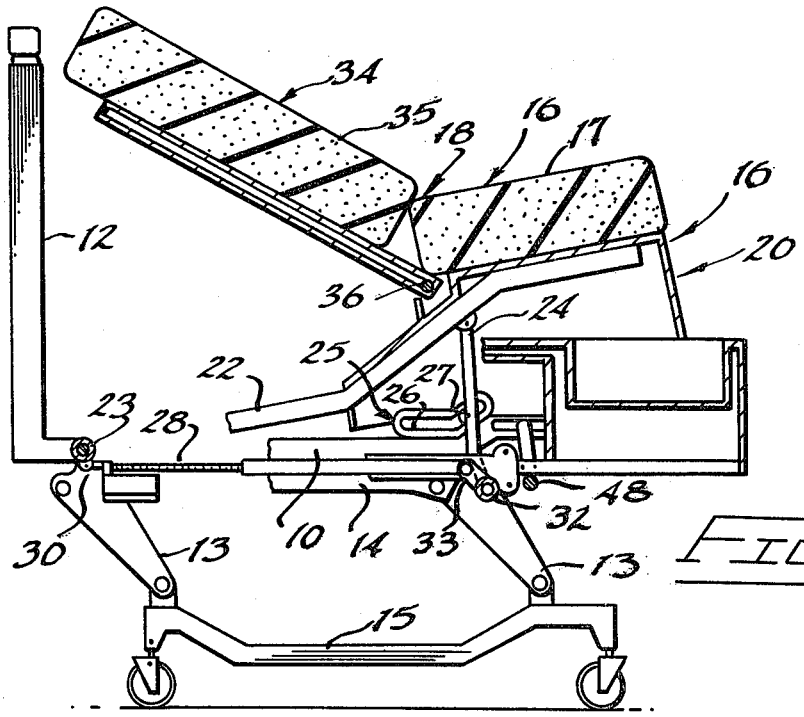
FIG. 10 is a sectional view taken along line 10—10 in FIG. 1, showing the bed configuration of FIG. 5.
Figure 11:
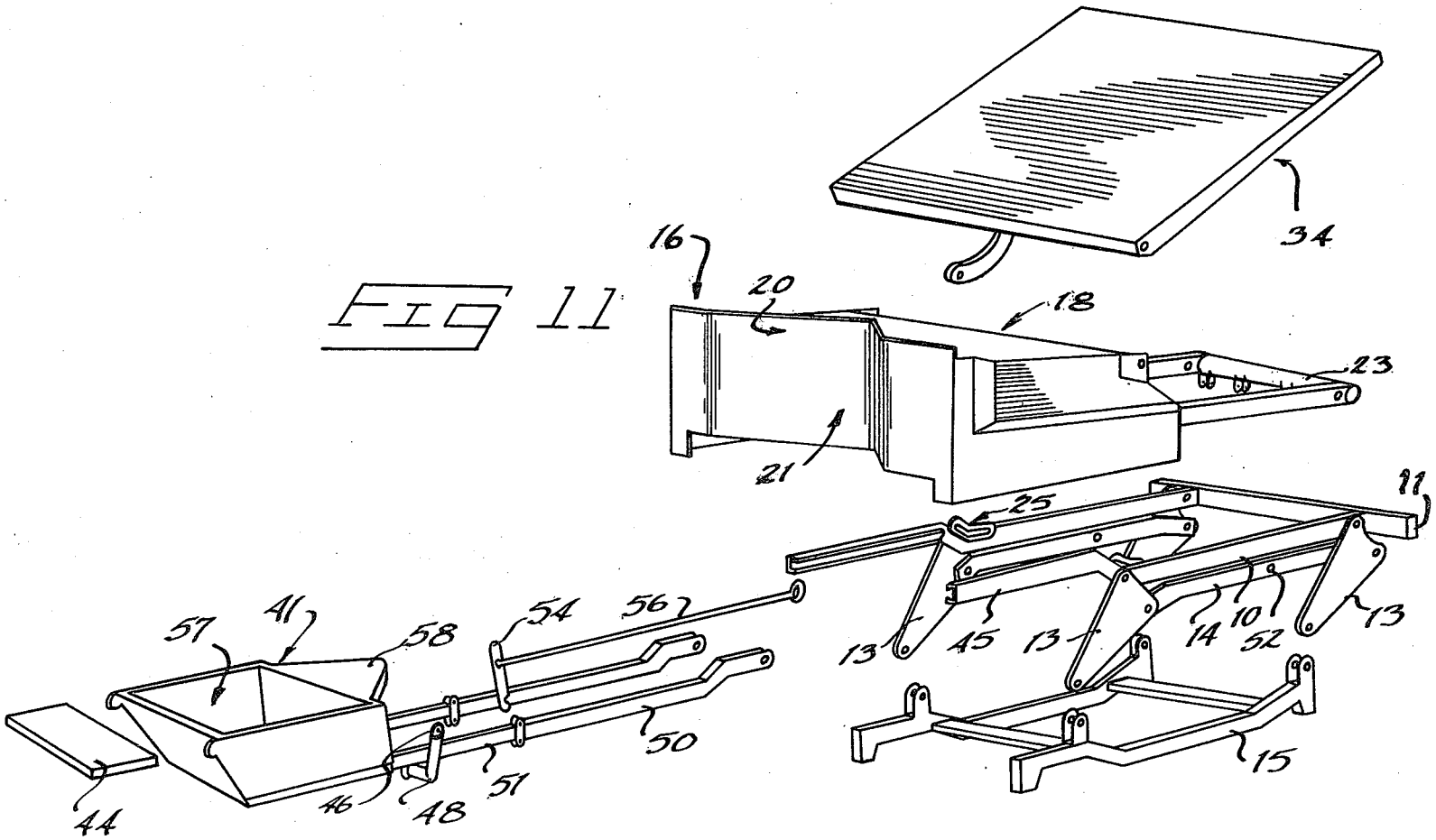
FIG. 11 is a simplified exploded view of the bed mechanical components.

The angular position of the seat section 16 about its axis on the framework is controlled by upright support arms 24 at the respective sides of the bed (FIG. 10). The support arms 24 carry individual cam followers 27 guided along inclined slots 26 in cams 25 fixed to the frame sides 10. A second extensible motorized shaft assembly 28 is mounted between a pivotable anchor 30 on cross member 23 and a pivotal connection 33 on a transverse brace 32 fixed between support arms 24.

As the extensible shaft 28 is either lengthened or shortened, its movement will be transmitted to the seat section 16 as angular movement about the axis of cross member 23. This angular movement will elevationally raise or lower the end 20 of the seat section 16, and will vary the rearward inclination of its upper patient support surface 17.

Figure 7:
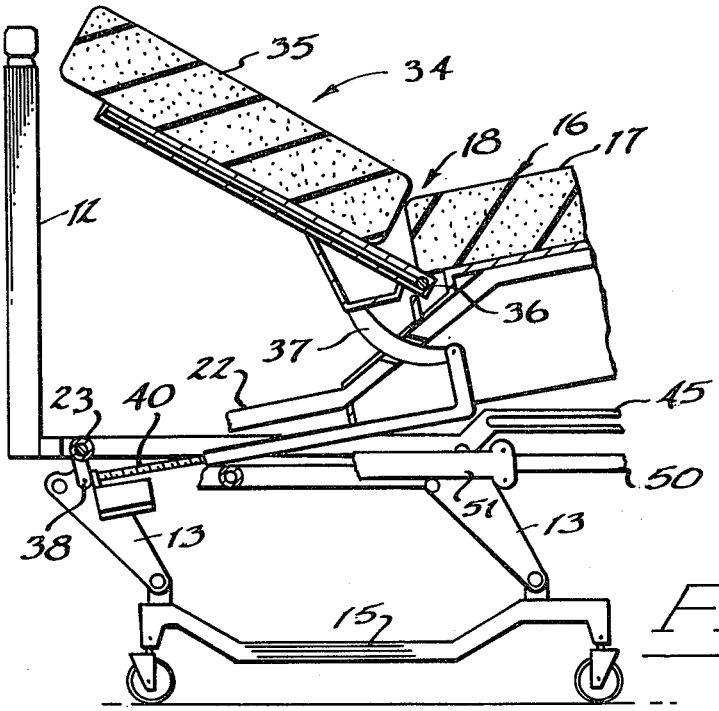
FIG. 7 is a fragmentary sectional view taken along line 7—7 in FIG. 1, showing the raised backrest.

The head section 34 is pivoted to the upper end 18 of seat section 16 at 36. Its lower end includes a rigid curved support arm 37 that protrudes beneath the seat section 16. The lower end of arm 37 is pivotally connected to one end of a third extensible motorized shaft assembly 40 (FIG. 7) having an outer end pivotally connected to cross member 23 at 38.

Figure 8:
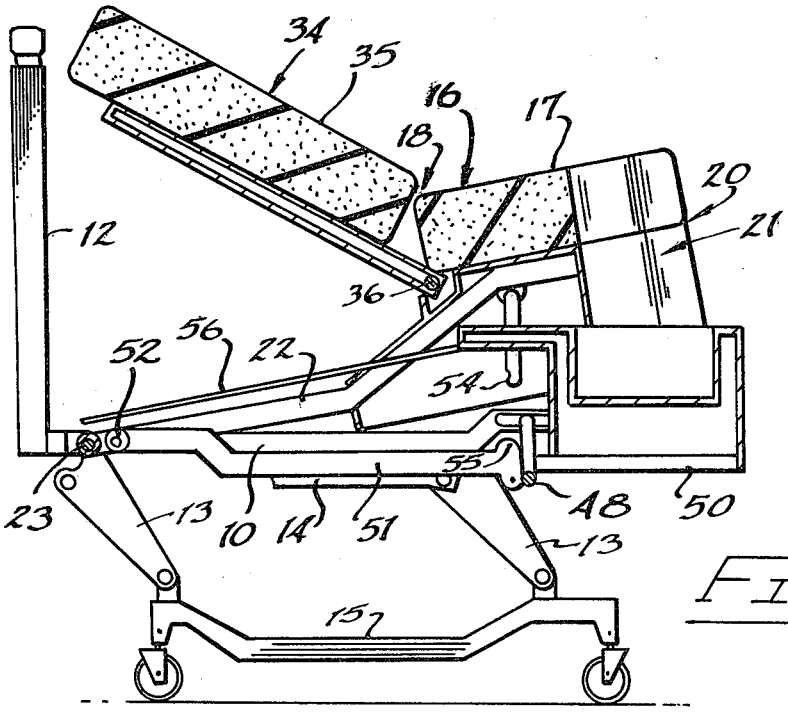
FIG. 8 is a sectional view taken along line 8—8 in FIG. 1, showing the bed configuration of FIG. 5.

Foot section 41 is carried on the framework by a pair of rigid longitudinal arms 50 protruding outwardly from it and slidably received within the open longitudinal ends of supporting tracks 51. The tracks 51 are movably mounted to the framework about an axis shown at 52 (FIG. 8). The location of axis 52 is immediately adjacent the head end of the framework and the axis of cross member 23. The foot section 41 and seat section 16 are therefore mounted about substantially identical pivot axes for movement relative to the supporting framework.

The location of pivot 52 should be arranged as far toward the head of the bed as is practical. This minimizes the resulting inclination of foot section 41 in response to its elevational adjustment relative to seat section 16.

Foot section 41 is elevationally carried by a transverse member 48 pivotally connected beneath the arms 50. The outer ends of the member 48 are fixed to a pair of suspension arms 47 having upper rollers 46 that ride along tracks 45 provided as extensions of the frame sides 10.

When the foot section 41 is in its longitudinally extended position relative to the seat section 16, it can be manually lifted or lowered between a raised position (FIG. 3) and a lowered position (FIG. 4). This movement is accommodated by the pivotal motion of member 48 and rolling movement of the rollers 46 along the tracks 45.

The foot section and arms 50 are vertically suspended by the rollers 46 and arms 47 when foot section 41 is in its lowered position. However, they can be locked in the raised position by a latch 54 (FIGS. 6, 9) that selectively engages a transverse rod 55 fixed across the open ends of the pivoted tracks 51. Latch 54 is manually controlled through a longitudinal operator 56 to selectively engage or release rod 55 as desired.

Foot section 41 is longitudinally movable relative to seat section 16 when the seat section 16 is in its raised position and foot section 41 is in its lowered position. Foot section 41 can then be manually pushed beneath the lower end 20 of seat section 16. This reduces the physical obstruction to access at the lower end 20 of the seat section 16. It also locates receptacle 57 within the space elevationally below indentation 21 for collection of drainage fluids.

Foot section 41 pivotally supports a transverse tray 44 at its lower end. The tray 44 serves as an extension for support of articles resting upon it when the foot section 41 is in its lower retracted position.

The independent pivotal connections that support seat section 16 and foot section 41 adjacent to the head end of the bed framework permit independent elevational adjustment of one relative to the other. With the extended foot section 41 in its lowered position (FIG. 4), the seat section 16 and head section 34 can be raised or lowered without resulting movement of the foot section 16 to accommodate the size and needs of a supported patient.

Foot section 41 can be independently supported on the framework in its lowered position (FIG. 4) or can be fixed to seat section 16 as an extension of it. This effectively converts the apparatus from a chair configuration to a bed configuration.

While the foot section 41 is independently supported on the framework, it can be raised or lowered without affecting the position of seat section 16. While the illustrated support for foot section 41 is manually moved, a powered mechanism can be provided if desired.

The bed length can also be collapsed or shortened when the seat section 16 is raised, by moving foot section 41 longitudinally beneath it from the position in FIG. 4 to the position in FIG. 5.

The versatility and adjustability of the bed is believed to be evident from the above discussion. The seat section 16, head section 34 and foot section 41 can be arranged to accommodate the varying needs of both the patient and the attending personnel. Despite its several functional modes relating to childbirth procedures, the bed retains the appearance of a normal bed when these three sections are horizontally aligned with one another. They are elevationally adjustable as a unit. The bed provides acceptable support for a patient at all stages before, during and after childbirth.

I claim:

1. A combination labor, delivery and patient care bed, comprising:

a seat section elevationally movable relative to the floor between a lowered position and a raised position;

a foot section elevationally movable independently of the seat section for movement between raised and lowered positions outward from the seat section, and longitudinally movable to a position beneath the seat section;

and common framework means supporting said seat section and foot section independently of one another for relative movement of either with respect to the other.

2. A bed as claimed in claim 1, wherein the seat section has a planar upper patient support surface;

said foot section also having a planar upper patient support surface;

the foot section further including an inner transverse end complementary to the remaining end of the seat section.

3. A bed as claimed in claim 1, wherein the seat section has a planar upper patient support surface;

said foot section also having a planar upper patient support surface;

the foot section further including an inner transverse end complementary to the remaining end of the seat section;

and releasable means on the seat section and foot section for selectively fixing them to one another with their respective upper patient support surfaces in a common plane.

4. A combination labor, delivery and patient care bed, comprising:

a seat section elevationally movable between a lowered position and a raised position, said seat section having an upper patient support surface;

a foot section at one end of the seat section, said foot section being movably mounted for elevational and longitudinal movement relative to the seat section and also having an upper patient support surface;

an operational framework means interconnecting the seat section and foot section for selectively supporting them relative to one another as follows:

a first condition in which both the seat section and the foot section are independently movable relative to one another;

a second condition in which the foot section is selectively fixed to the seat section for conjoint movement with the seat section with their respective upper patient support surfaces being coplanar;

a third condition in which the foot section is retracted beneath the seat section.

5. A combination labor, delivery and patient care bed, comprising:

a framework supportable on a floor;

seat means movably mounted on the framework for elevational adjustment relative to the bed framework between a lowered position and a raised position;

head means movably mounted about a transverse axis at one end of the seat means for angular adjustment relative to the seat means;

foot means adjacent the remaining end of the seat means, said foot means being movably mounted on the framework for both elevational and longitudinal movement independently of the seat means;

first means operably connected between the framework and seat means for selectively effecting elevational adjustment of the seat means independently from the foot means;

and second means operably connected between the framework and foot means for permitting the foot means to move between a raised position in which it is an extension of the seat means and a lowered position in which the foot means can be either located outward from the seat means or can be retracted beneath the remaining end of the seat means.

6. A bed as claimed in claim 5 wherein the bed framework is elevationally adjustable relative to the floor.

7. A bed as claimed in claim 5 wherein the remaining end of the seat means is transversely recessed to form an indentation across it.

8. A bed as claimed in claim 5 wherein the remaining end of the seat means is transversely recessed to form an indentation across it;

said foot means including an upwardly open receptacle which can be located elevationally below the indentation formed across the remaining end of the seat means while the foot means is retracted beneath the seat means.

9. A combination labor, delivery and patient care bed, comprising:

a framework supportable on a floor and having a transverse head end;

a seat section having an upper patient support surface spaced longitudinally from the head end of the framework, the seat section being pivotally mounted to the framework about a transverse axis adjacent its head end;

the upper patient support surface of the seat section having a first transverse end facing toward the head of the framework and a second transverse end facing oppositely;

a head section having an upper patient support surface, said head section being pivotally mounted to the seat section adjacent the first transverse end thereof;

and a foot section having an upper patient support surface, the foot section being movably mounted to the framework about a transverse axis adjacent its head end;

means mounting the foot section to the framework for independent elevational adjustment of the foot section relative to the seat section between an extended raised position at which the upper patient support surface of the foot section is an extension of the upper patient support surface of the seat section and an extended lowered position at which it is located below and outward of the seat section;

said last-named means further mounting the foot section for longitudinal retraction beneath the seat section.

10. A combination labor, delivery and patient care bed, comprising:

an elevationally adjustable framework supported on a floor;

a seat section pivotally mounted to said framework about a transverse axis, said seat section extending between a transverse upper end and a transverse lower end;

a head section pivotally mounted to said framework adjacent the transverse upper end of the seat section;

a foot section movably mounted to said framework at the lower end of said seat section;

first adjustment means operably connected between the framework and the foot section for selectively moving the foot section between a raised position where it serves as an extension of the seat section and a lowered position where it protrudes outwardly beyond the transverse lower end of the seat section;

section adjustment means operably connected between the framework and the seat section for selectively moving the seat section about said transverse axis relative to the framework and independently of said foot section;

and third adjustment means operably connected between the framework and the foot section for selectively moving the foot section to a retracted position beneath the seat section;

whereby the bed can be effectively converted between an elevationally adjustable bed configuration and an elevationally adjustable chair configuration.

* * * * *